United States Patent [19]

Barthelmess

[11] 4,409,097

[45] Oct. 11, 1983

[54] IMPROVED PIVOTABLE CENTRIFUGAL CLASSIFIER AND METHOD OF CLASSIFYING

[75] Inventor: Ulrich Barthelmess, Niederstotzingen, Fed. Rep. of Germany

[73] Assignee: OMYA GmbH, Cologne, Fed. Rep. of Germany

[21] Appl. No.: 312,028

[22] Filed: Oct. 16, 1981

[51] Int. Cl.[3] ..... B07B 7/083

[52] U.S. Cl. ..... 209/11; 209/144

[58] Field of Search ..... 209/11, 144, 139 A, 209/145, 139 R

[56] References Cited

U.S. PATENT DOCUMENTS

| | | | |
|---|---|---|---|
| 2,758,713 | 8/1956 | Hardinge | 209/144 |
| 3,384,238 | 5/1968 | Alpha | 209/144 X |
| 3,901,794 | 8/1975 | Henne et al. | 209/11 |
| 4,296,864 | 10/1981 | Misaka et al. | 209/144 |

FOREIGN PATENT DOCUMENTS

| | | | |
|---|---|---|---|
| 580847 | 7/1933 | Fed. Rep. of Germany | 209/144 |
| 647888 | 5/1937 | Fed. Rep. of Germany | 209/144 |
| 1918573 | 10/1970 | Fed. Rep. of Germany | 209/11 |

*Primary Examiner*—Ralph J. Hill

*Attorney, Agent, or Firm*—Pollock, Vande Sande & Priddy

[57] ABSTRACT

A centrifugal classifier is disclosed having a high and adjustable yield of fine material. The classifier has a substantially cylindrical upright housing with an approximately tangential sifting-air inlet, in which are arranged, at a radial distance from, and centrally of, the casing of the housing, a vane-ring and, at a radial distance, inwardly therefrom, a sifting rotor with a lamination-ring forming radial passages, an inlet for the granular material to be classified opening, at the top, into the classifying area located between the said vane-ring and sifting rotor, and an outlet for the sifting air, charged with fine material, being located adjacent the rotor, the diameter of the outlet corresponding approximately to the inside diameter of the rotor, and the sifting-air inlet and the vane-ring extending over approximately the same axial length as the rotor, characterized in that the classifier as a whole is adapted to pivot about a horizontal axis.

10 Claims, 3 Drawing Figures

IMPROVED PIVOTABLE CENTRIFUGAL CLASSIFIER AND METHOD OF CLASSIFYING

TECHNICAL FIELD

The invention relates to a centrifugal classifier.

BACKGROUND ART

A classifier of this kind, as already known from German OS No. 1,607,631, is used for classifying, i.e. separating a mixture or quantity of granular material of different sizes and/or different shapes and/or different specific weight, into coarse material or coarse grains (of a grain-size above a certain diameter) and fine material (of a grain-size below that limit). The material to be classified is charged from above into a classifying area (an annular space between a vane-ring and a sifting rotor); at the same time, sifting air flows from the outside, through the vane-ring, into the classifying area, thus following a spiral path and carrying the particles along accordingly. In the classifying area, the particles are subjected to radially directed resistance and centrifugal forces acting in opposite directions. For a specific radial and axial air-velocity, there exists a limiting grain size at which the two forces are equal.

The coarser particles (coarser than the limiting size) thus arrive sooner or later at the coarse-material outlet at the bottom of the classifying area. The fine material, on the other hand, is carried along with the sifting air which flows inwardly through the passages in the sifting wheel and is drawn off through a fine-material/sifting-air outlet adjoining axially the interior of the sifting wheel. The fine material is finally separated from, or precipitated out of, the sifting air which can then be returned to the sifting-air inlet, i.e. it can be circulated. Classifiers of this kind are used mainly for recovering fine material of the smallest possible grain-size and in a narrow grain-size distribution, the upper limit sought being between 2 and 4 μm. This very fine granular material is frequently used as a filler, for synthetic material, automobile tires, colours, paints or coating agents for paper. The coarse material is used for other purposes, or is re-ground to yield further fine material.

In order to obtain economical operation, it is therefore highly important that as much as possible of the fine material contained in the granular material charged into the classifier be separated as it passes therethrough, and that the throughput be relatively high and adjustable.

DISCLOSURE OF THE INVENTION

It is therefore the purpose of the invention to provide a classifier of this kind having a high yield of fine material. (The "yield of fine material" is the proportion of fine material discharged, i.e., recovered from all of the fine material contained in mixed material charged into the classifier). According to the invention, this purpose is achieved in that the classifier as a whole is adapted to pivot about a horizontal axis. In this way, depending upon the inclination, the period of residence of the mixture of particles in the classifying area may be adjusted according to grain size, density and other factors. The longer the period of residence, the higher the percentage of fine material removed from the charge. Moreover, particularly large particles drop out of the inclined sifting rotor under the action of gravity, are accelerated away from the rotor, and strike the guide-vanes. In addition to a disintegrating effect, this produces above all disaggregation, i.e. any fine material is released from the coarse material; the said fine material is thus passed through the sifting rotor and is not "lost" with the coarse material.

According to a further configuration of the invention, each end of the sifting rotor is surrounded by a deflector ring. These deflector rings equalize the flow and thus increase selectivity. According to another design, in order that the classifier may be universally applicable, the individual guide-vanes are radially displaceable. This is achieved in that the two ends of the said guide-vanes are guided radially in the housing covers and are adjustable in the guides. This permits the radial depth of the classifying area to be adjusted optimally, so that the separating zone lies relatively near the outside diameter of the sifting rotor. This ensures that all fine material reaches the area near the rotor and is drawn in by the sifting air. If the separating zone were to be too remote from the sifting rotor, the fine material would pass, with the coarse material, to the coarse-material outlet. In particular, the width and radial length of the classifying area can be hereby optimally adapted to the inclined position selected and thus to the period of residence.

The classifier according to the invention may be provided with a single fine-material/sifting-air outlet. According to one configuration, however, a fine-material/sifting-air outlet adjoins each end-face of the sifting rotor. In addition to increasing the yield of fine material, this also increases the throughput.

The two fine-material/sifting-air outlets almost double the cross-section of the outlet, so that in spite of the increased throughput, the flow velocity is lower. With the high flow-velocities hitherto used, the fine material strikes the walls so violently that it adheres thereto, especially if an initial coating of fine material has already been deposited thereon. This progressively impairs the flow conditions and results in a decrease in throughput.

Above all, however, some of these stratified deposited (so-called "eggshells") burst and pass into the fine material which leads to major difficulties or even renders the fine material useless. In order to avoid these deposits, therefore, the flow rate has been limited, but this also limits the throughput.

According to the invention, these deposits of fine material are prevented by surrounding the two fine-material/sifting-air outlets, in the vicinity of the rotor, with cooling chambers, since cooler particles adhere less easily to a cooled surface. In this connection, it is desirable to arrange the bearings at each end of the sifting-rotor shaft in the cooling chambers. This also cools the bearings, thus increasing the reliability and life of the machine.

According to another configuration, a labyrinth-seal is provided at each end-face of the sifting rotor, each of the said seals communicating through a duct with one of the cooling chambers. This flushing prevents the coarse material from passing from the classifying area into the sifting-air/fine-material outlets, or outlet.

BRIEF DESCRIPTION OF THE DRAWINGS

A better explanation is provided by the following description of an example of embodiment of the invention, in conjunction with the drawing attached hereto, wherein.

BEST MODE FOR CARRYING OUT THE INVENTION

Figure 1:
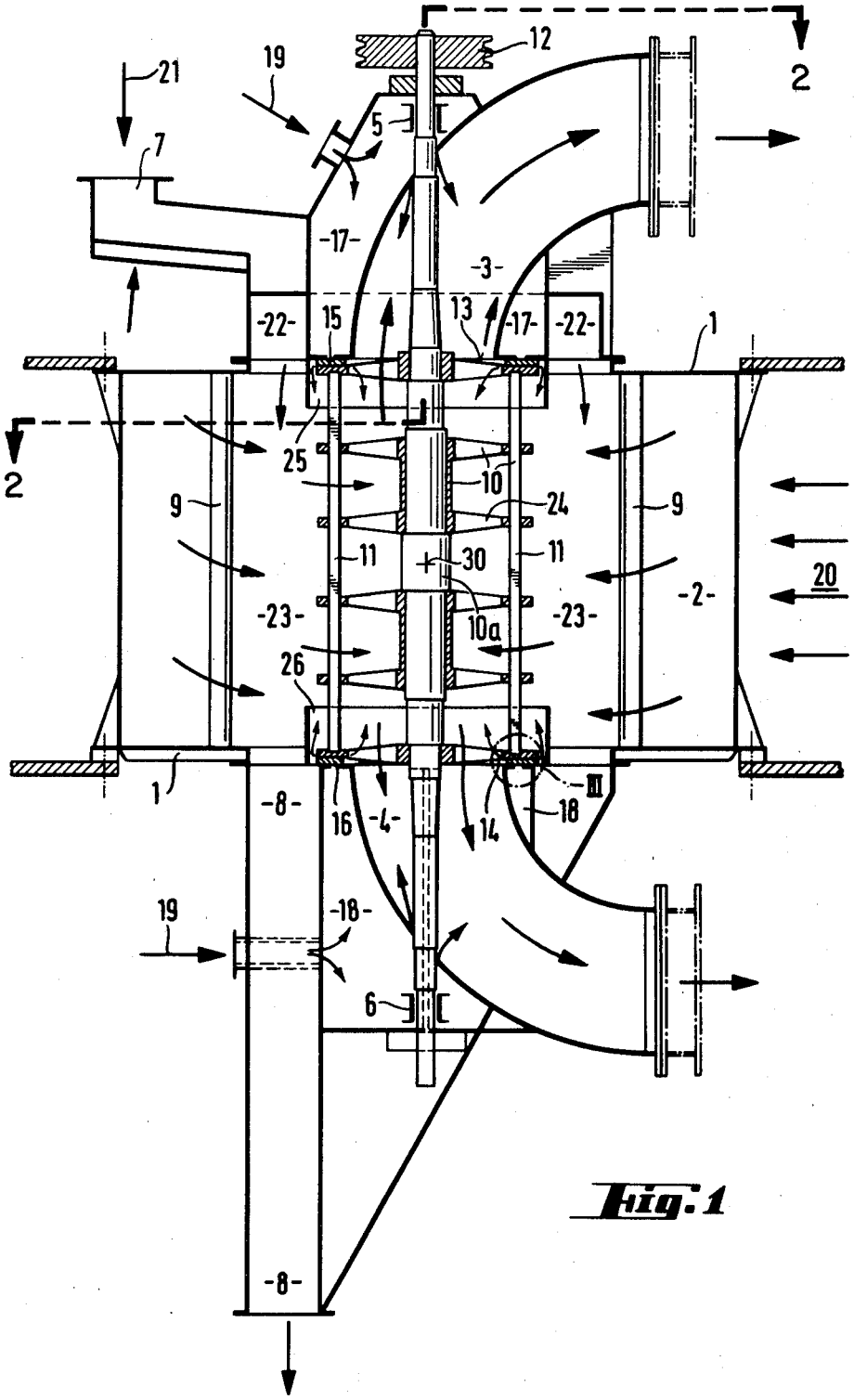
FIG. 1 is a longitudinal section through a classifier according to the invention.
Figure 2:
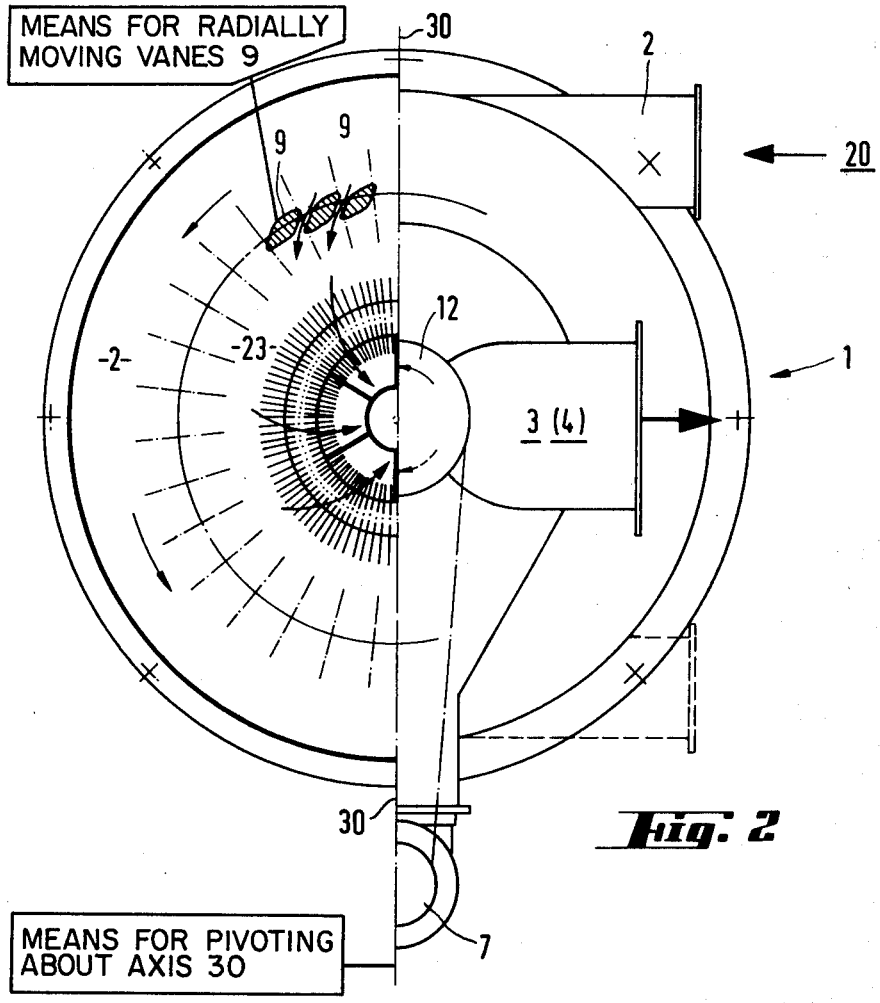
FIG. 2 is a view of the classifier from above, to the left in cross-section and to the right in plan-view.

The classifier comprises a concentric, substantially cylindrical housing 1 with a tangential sifting-air inlet 2, into which the sifting air enters, uniformly over the entire axial height, in the direction of arrows 20.

A vane-ring 9 is arranged in the said housing, spaced radially from the casing thereof. Lamination-ring 11 on the sifting rotor is also spaced radially from the vane-ring 9. The granular material to be separated is charged from above into classifying area 23 between vane-ring 9 and rotor lamination-ring 11. An annular duct 22, for injecting the granular material, is provided in the upper part of the housing wall, with a connector 7 opening into the said duct. Located at the opposite, i.e. the lower, end-face of the housing is a funnel-shaped coarse-material outlet 8.

Located at each end of the sifting rotor is a fine-material/sifting-air outlet 3,4 in the form of a curved piece of pipe, the diameter of which corresponds approximately to the inside diameter of the rotor. According to the invention, the classifier as a whole is adapted to pivot about a horizontal axis. In this present example of embodiment, pivot axis 30 runs at right angles to the plane defined by outlets 3,4, approximately centrally between them. The pivot-axis may be mounted in a manner known per se.

sifting-air/fine-material outlets 3,4 are each surrounded by a cooling-air chamber 17,18 to each of which cooling air is supplied through a connection 19 which prevents fine material from being deposited in the said outlets. Also mounted in cooling-air chambers 17, 18, at both ends, in bearing brackets 5,6, is the rotor-shaft 10*a* which passes through curved outlets 3,4. The bearings are thus also cooled. Due to the positive pressure obtaining in the said cooling-air chambers, no fine material can enter them (see arrows in shaft lead-throughs). Drive is by a V/belt pulley 12.

Figure 3:
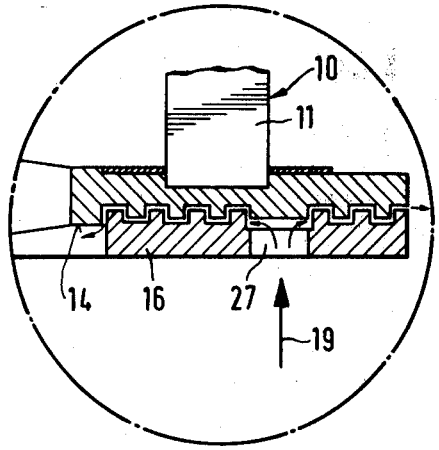
FIG. 3 is an enlarged view of detail III in FIG. 1, namely of the labyrinth-seal with a supply of flushing air from the cooling chamber.

Sifting rotor 10 is open at both end-faces in such a manner that it is sealed to outlets 3,4. Located between the sifting rotor and the housing is a seal 15,16 in the form of a flat disc or a labyrinth. Flushing air is introduced from cooling-air chambers 17,18, through a duct 27, to provide a seal between sifting area 23 and outlets 3,4 (arrow 19 in FIG. 3).

Support-discs 24, equipped with radial passages, are shrunk onto shaft 10*a* of the sifting rotor. The outer periphery of each end of the rotor is surrounded by a deflector ring 25,26.

The embodiments of the invention in which an exclusive property or privilege is claimed are defined as follows:

1. An improved centrifugal classifier, comprising:

a substantially cylindrical housing having an approximately tangential inlet for classifying air;

a vane ring arranged centrally within said housing and spaced radially inwardly from the casing thereof, said vane ring being of approximately the same axial length as said inlet for classifying air;

a classifying rotor arranged for rotation within and spaced radially inwardly from said vane ring, said rotor also being of approximately the same axial length as said inlet for classifying air and comprising a circumferentially and axially extending lamination ring defining radially extending passages leading from the outside diameter of said rotor to an axially extending interior volume in said rotor, said interior volume being open to flow of air and fine granular material passing from said radial passages and defining an inside diameter for said rotor;

an inlet for granular material to be classified, said inlet opening at one end of said classifier into a classifying area located between said vane ring and said lamination ring;

a first outlet for coarse granular material and air, said first outlet opening from said classifying area;

a second outlet for fine granular material and air, said second outlet being located adjacent said interior volume, the diameter of said second outlet corresponding approximately to said inside diameter of said rotor; and means for pivoting said classifier about a horizontal axis, to vary the residence time of material in said classifying area and thereby vary the percentage of fine granular material removed from material to be classified.

2. The classifier according to claim 1, characterized in that each end-face of said rotor is surrounded by a deflector ring.

3. The classifier according to claim 1 characterized in that a fine granular material and air outlet adjoins each end-face of said rotor.

4. The classifier according to claim 1, further characterized by means for adjusting the vanes in said guide-vane ring in their radial distance from said rotor, to vary the radial depth of said classifying area and thereby vary the percentage of fine granular material drawn into said rotor by said classifying air.

5. The classifier according to claim 4 characterized in that a fine granular material and air outlet adjoins each end-face of said rotor.

6. The classifier according to claim 1 characterized in that a fine granular material and air outlet adjoins each end-face of said rotor.

7. The classifier according to claim 1, characterized in that in the vicinity of said rotor, said second outlet is surrounded by a cooling chamber.

8. The classifier according to claim 7, characterized in that a labyrinth-seal is provided at each end-face of said rotor, each seal communicating through a duct with one of said cooling chambers.

9. An improved method for classifying granular material, comprising the steps of:

providing a centrifugal classifier of the type including a substantially cylindrical housing having an approximately tangential inlet for classifying air;

a vane ring arranged centrally within said housing and spaced radially inwardly from the casing thereof, said vane ring being of approximately the same axial length as said inlet for classifying air;

a classifying rotor arranged for rotation within and spaced radially inwardly from said vane ring, said rotor also being of approximately the same axial length as said inlet for classifying air and comprising a circumferentially and axially extending lamination ring defining radially extending passages leading from the outside diameter of said rotor to an axially extending interior volume in said rotor, said interior volume being open to flow of air and fine granular material passing from said radial passages and defining an inside diameter for said rotor;

an inlet for granular material to be classified, said inlet opening into a classifying area located between said vane ring and said lamination ring;

a first outlet for coarse granular material and air, said first outlet opening from said classifying area;

a second outlet for fine granular material and air, said second outlet being located adjacent said interior volume, the diameter of said second outlet corresponding approximately to said inside diameter of said rotor; and pivoting said classifier about a horizontal axis to vary the period of residence of said granular material in said classifying area and thereby vary the percentage of fine granular material removed from material to be classified.

10. A method according to claim 9, further comprising the steps of radially adjusting the position of said vane ring to facilitate movement of said granular material toward said rotor and thereby vary the percentage of fine granular material drawn into said rotor by said classifying air.

* * * * *